US007587849B2

(12) United States Patent
Robbins et al.

(10) Patent No.: US 7,587,849 B2
(45) Date of Patent: Sep. 15, 2009

(54) IN-STORE MARKETING DISPLAY INSERT

(75) Inventors: Holly A. Robbins, Minneapolis, MN (US); Natalie K. Wozniak, St. Paul, MN (US); Rohland W. Wiltfang, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 169 days.

(21) Appl. No.: 11/695,756

(22) Filed: Apr. 3, 2007

(65) Prior Publication Data

US 2008/0244945 A1 Oct. 9, 2008

(51) Int. Cl.
*G09F 3/18* (2006.01)

(52) U.S. Cl. ..... 40/661.03; 40/672; 40/661.08

(58) Field of Classification Search ..... 40/124, 40/606, 638, 642, 661, 672, 641, 359, 360, 40/654, 124.05, 124.09, 124.14, 642.01, 40/649, 661.03, 661.06, 661.07, 661.08; 428/121

See application file for complete search history.

(56) References Cited

U.S. PATENT DOCUMENTS 2,297,888 A * 10/1942 Heileman ..... 40/649
2,720,044 A 10/1955 Montalto
2,984,031 A 5/1961 Giesecke
3,077,686 A 2/1963 Montalto
3,423,860 A 1/1969 Berry, Jr. et al.
3,706,150 A * 12/1972 Greenberger ..... 40/661.03
3,774,328 A 11/1973 Tanney
3,977,109 A 8/1976 Berry, Jr. et al.
4,141,529 A * 2/1979 Casutt ..... 248/686
4,161,074 A 7/1979 DePinna
4,306,366 A 12/1981 Taub
4,338,739 A * 7/1982 Greenberger ..... 40/584
4,471,544 A 9/1984 Nelles et al.
4,716,669 A 1/1988 Fast
4,718,627 A * 1/1988 Fast et al. ..... 248/225
4,798,014 A * 1/1989 Stoerzinger et al. ..... 40/124.1
5,848,698 A 12/1998 Stompe
6,701,653 B2 * 3/2004 Chess et al. ..... 40/638
6,817,127 B2 11/2004 Gottlieb et al.

* cited by examiner

*Primary Examiner*—Lesley D Morris
*Assistant Examiner*—Kristina Staley
(74) *Attorney, Agent, or Firm*—Leanne Taveggia Farrell; Westman, Champlin & Kelly, P.A.

(57) ABSTRACT

The shape of a marketing display insert allows it to be used in different price label fixtures. The shape of the marketing display insert is defined by a base portion that is wider than it is tall, a support portion that extends from the base portion, and a flag portion that extends from the support portion and is cantilevered over and separated from the base portion. For shelf-type display structures, cantilevering a flag above a base portion allows the marketing display insert to be inserted into the top of a price label fixture. For peg hook-type display structures, the space between the base portion and the flag portion allows the base portion to be inserted into a price label fixture from the side. In addition, a score between the flag portion and the support portion allows the flag portion to be bent out of plane from the base portion.

23 Claims, 7 Drawing Sheets

IN-STORE MARKETING DISPLAY INSERT

BACKGROUND

In the retail industry, a retail establishment commonly uses various types of display structures to present products to customers for purchase. These display structures both support the product for display while simultaneously indicating to the customer the product price. Example display structures include shelf-type structures and rack/hook-type structures.

In general, shelf-type display structures display the product by resting it on a shelving unit raised off of the floor. Each shelf display structure includes a price label support that supports a price label. The price label provides pricing and product information for the products stacked on the shelves. In general, shelf-type display structures provide a channel price label support that runs the length of the shelf such that price labels are inserted into the channel in a top down manner.

Rack/hook-type display structures generally display products by hanging the products from a rack or pegged hook. Typically, each rack or pegged hook supports a sleeve price label support wherein the price label is inserted into an opening in the side of the sleeve.

Often, retailers desire to highlight certain products that are being displayed. For example, a retailer may want to bring certain products to the attention of the customer based on the fact that they were advertised in a certain media format, such as a catalog, a mailer or a commercial. In addition, a retailer may want to highlight certain products that have certain characteristics not possessed by similarly displayed products, such as products that are on sale. Often, retailers highlight these select products by enhancing the visual appearance of the price labels by adding additional visual elements such as tags that indicate that the product is on sale or that the product was featured in an advertisement. These tags are supported by the display structure and typically extend beyond the normal price label so that they draw more attention.

With the variety of different types of display structures, enhancing the visual appearance of the price label can become labor intensive. In particular, because different display structures support price labels differently, such as a top opening channel price label support versus a side opening sleeve price label support, and because different price label supports have different shapes, separate tags had to be designed and constructed for each type of price label support found in a retail establishment. This greatly increased the cost of forming new tags. In addition, it can be difficult for a large retailer that has numerous retail outlets or stores to know how many of each type of price label support is found in each store. As a result, it is difficult to know how many of each type of tag to send to each store.

The discussion above is merely provided for general background information and is not intended to be used as an aid in determining the scope of the claimed subject matter.

SUMMARY

The unique shape of a marketing display insert according to embodiments of the invention allows it to be used in multiple different price label fixtures. The shape of the marketing display insert is defined by a base portion that is wider than it is tall, a support portion that extends from the base portion, and a flag portion that extends from the support portion and is cantilevered over and separated by a distance from the base portion. For shelf-type display structures, cantilevering a flag above a base portion allows a marketing display insert to be inserted into a top of a price label fixture without obscuring the information on the flag portion. For peg hook-type display structures, the space between the base portion and the flag portion and the fact that the base portion is wider than it is tall allows the base portion to be inserted into the price label fixture from the side such that the flag portion appears above the price label fixture. In addition, a score between the flag portion and the support portion allows the flag portion to be bent out of plane from the base portion in the price label fixtures for both the shelf-type display structures and the peg hook-type display structures.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Embodiments described herein utilize a marketing display insert made from a sheet material to enhance the visual appearance around various types of price label fixtures coupled to a variety of different types of display structures. The marketing display insert can be utilized in a shelf-type display structure, which includes a price label fixture having an in-line shelf strip for supporting at least one price label as well as pegged hook-type display structures, which include price label fixtures having a stand-alone support fixture. In some embodiments, the marketing display insert is oriented into a first orientation regardless of the type of price label fixture with which it is used. In other embodiments, the marketing display insert is oriented into a second orientation regardless of the type of price label fixture with which it is used.

Figure 1:
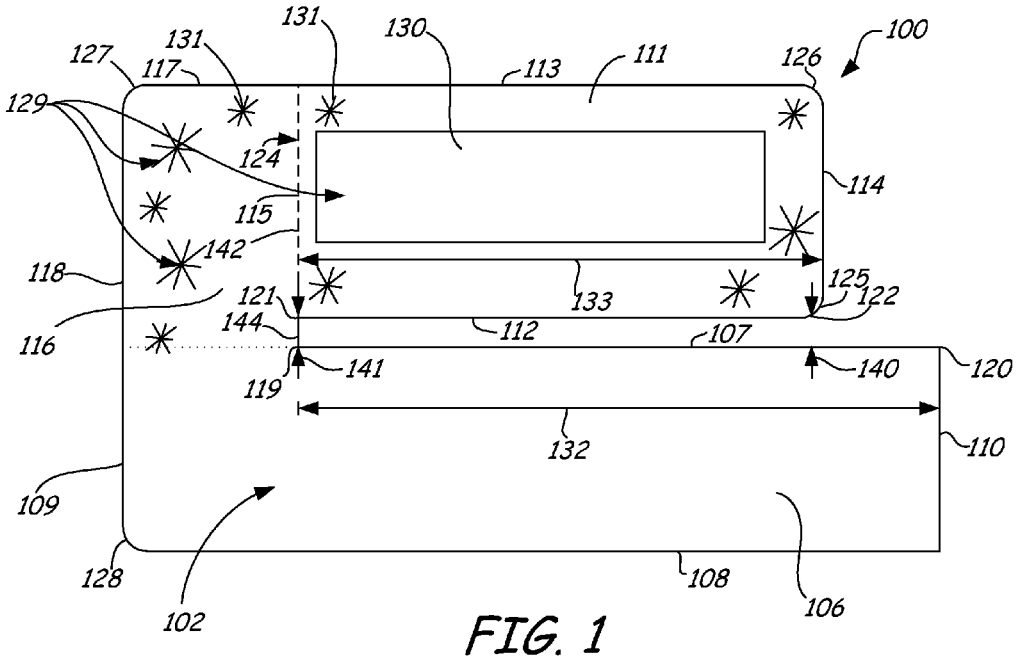
FIG. 1 is a front view of a marketing display insert under one embodiment.
Figure 2:
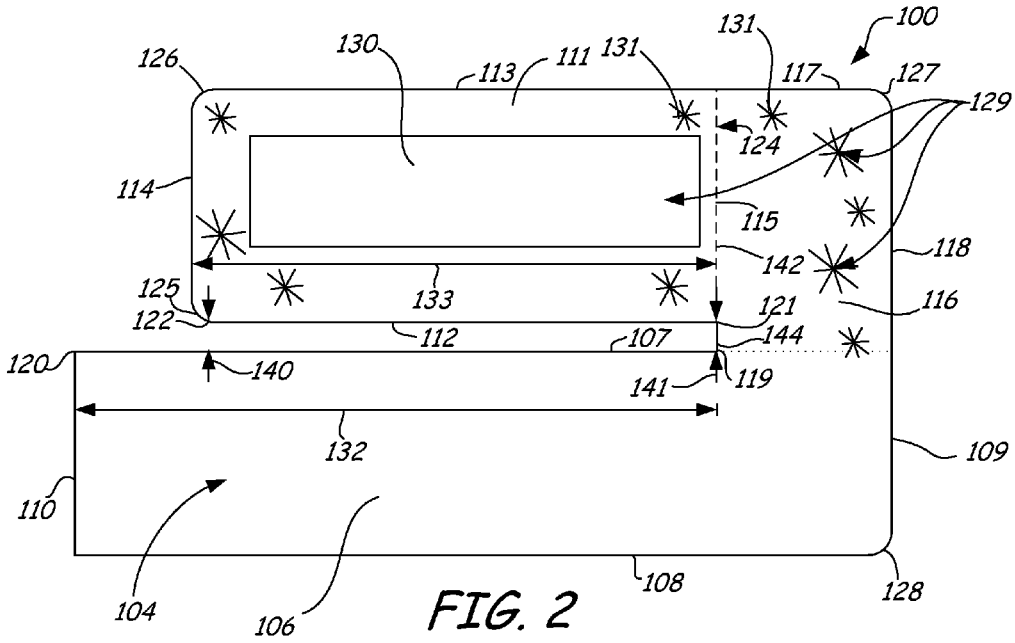
FIG. 2 is a back view of the marketing display insert of FIG. 1.

FIG. 1 is a front view of a marketing display insert 100 showing a first surface 102 under one embodiment, while FIG. 2 is a back view of marketing display insert 100 showing an opposing second surface 104. Marketing display insert 100 is formed with a pliable yet resilient sheet material. One exemplary sheet material includes polystyrene, however, other resilient sheet materials may be used. The marketing display insert 100 can be manufactured with a variety of different types of die machines. In particular, the marketing display insert can be manufactured with a punch and die machine. Such a punch and die machine is configured to form edge ends as well as scores.

Marketing display insert 100 includes a base or bottom portion 106 as defined by a linear top edge 107, a bottom edge 108, a first side end 109 and a second side end 110. Marketing display insert 100 also includes a flag or cantilevered portion 111 defined by a bottom edge 112, a top edge 113, a free side end 114 and an attached end 115. Marketing display insert 100 also includes a support or connecting portion 116 that couples base portion 106 to flag portion 111. Support portion 116 is defined by a top edge 117 that is continuous with top edge 113 of flag portion 111 and a first side end or side edge 118 that is continuous with first side end 109 of base portion 106. Side edge 118 of support portion 116 meets first side end 109 at a point that is aligned with top edge 107. At least a portion of side edge 118 is at an angle to top edge 107 of base portion 106.

Top edge 107 of base portion 106 includes a first end 119 that terminates at support portion 116 and a second free end 120. Bottom edge 112 of flag portion 111 includes a first end 121 that terminates at support portion 116 and a second free end 122. As illustrated in FIGS. 1 and 2, attached end 115 attaches flag portion 111 to support portion 116 along a score 124. Score 124 extends along a line that separates flag portion 111 from support portion 116 and intersects with a line that top edge 107 extends along. Although score 124 is shown as being perpendicular to top edge 107, score 124 may be at other angles to top edge 107.

Bottom edge 112 of flag portion 111 faces top edge 107 of base portion 106. Second end 122 of bottom edge 112 is separated from top edge 107 of base portion 106 by a first distance 140, measured perpendicular to top edge 107. First end 119 of top edge 107 of base portion 106 is separated from first end 121 of bottom edge 112 of flag portion 111 by a second distance 141. First distance 140 is at least as great as second distance 141. Under one embodiment and as illustrated in FIGS. 1 and 2, first distance 140 is substantially equal to second distance 141, for example. Under some embodiments, first distance 140 and second distance are at least about 1/16 of an inch. For example, under one embodiment, first distance 140 and second distance 141 are about 5/32 of an inch. However, it should be understood that this value is an exemplary dimensional value and first distance 140 and second distance 141 can be other values as long as flag portion 111 is allowed to freely bend out of plane with respect to substantially coplanar support portion 116 and base portion 106 without impedance by a price label fixture.

Support portion 116 of marketing display insert 100 also includes a second side end 142, which opposes first side end or side edge 118 and is at least partially contiguous with attached end 115 of flag portion 111. Second side end 142 includes a side edge 144 that extends beyond attached end 115 to top edge 107 of base portion 106. Side edge 144 is at an angle to top edge 107. Side edge 144 defines the separation between top edge 107 of base portion 106 and bottom edge 112 of flag portion 111.

Top edge 107 of base portion 106 includes a width 132 that extends between first end 119 and second free end 120. Bottom edge 112 of flag portion 111 includes a width 133 that extends between attached end 115 and free side end 114. Under one embodiment, width 132 is at least as great as width 133. In general, width 132 is at least about 2¼ inches. In one embodiment, width 132 is about 2⅞ inches and width 133 is about 2¼ inches, for example. It should be understood, though, that these dimensional values are exemplary values and width 132 and width 133 can be any value as long as marketing display insert 100 is sized to fit relative to multiple different types of price label fixtures.

Under one embodiment, marketing display insert 100 includes eight edges with two interior corners and two exterior corners. Of the eight available corners, four corners are convexly rounded. As illustrated in FIGS. 1 and 2, marketing display insert 100 includes first convexly rounded corner 125 located at a junction of bottom edge 112 and free side end 114. Marketing display insert 100 also includes a second convexly rounded corner 126 located at a junction of top edge 113 and free side end 114. Marketing display insert 100 also includes a third convexly rounded corner 127 located at a junction of top edge 117 and first side end 118. Marketing display insert 100 also includes a fourth convexly rounded corner 128 located at a junction of bottom edge 108 and first side end 109. Each of the convexly rounded corners 125, 126, 127 and 128 serves as a safety mechanism when marketing display insert 100 is positioned in a price label fixture. For example, convexly rounded corners 125, 126, 127 and 128, as compared to sharp corners, are generally perceived as being safer to a customer or retail employee. Note that other corners are not rounded since they are designed to be placed within a support structure and as such would not be exposed to a customer.

Marketing display insert 100 includes indicia 129 on first surface 102 and second surface 104. One exemplary type of indicia includes informational or textual indicia 130 as included on first surface 102 and second surface 104 of flag portion 111. Information or textual indicia 130 can include alpha-numeric type characters. Informational or textual indicia 130 provides information to customers such as indicating that the product was advertised in some sort of media format, such as a catalog, a mailer or a commercial, and/or the product has certain characteristics not possessed by similarly displayed products, such as the product is on sale. For example, informational or textual indicia 130 can indicate that a product is "as advertised," a "catalog item," a "sale item," a "sugar-free candy," etc. Informational indicia are not placed on base portion 106 because base portion 106 is designed to be placed within a support structure and thus would be obscured.

Another exemplary type of indicia includes decorative indicia 131 as included on first surface 102 and second surface 104. In FIGS. 1 and 2, decorative indicia 131 are included on flag portion 111 and support portion 116. However, it should be understood that decorative indicia 131 can be located on any portion of marketing display insert 100.

Figure 3:
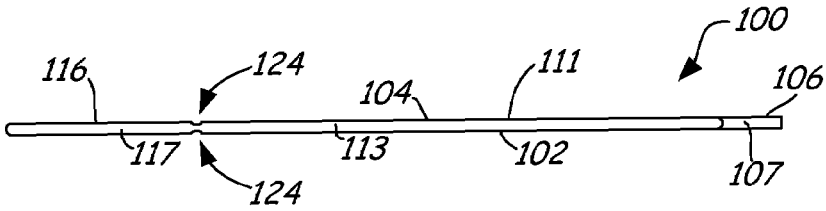
FIG. 3 is a top view of the marketing display insert illustrated in FIGS. 1 and 2 under one embodiment.

FIG. 3 illustrates a top view of marketing display insert 100 under one embodiment. In FIG. 3, top edge 113 of flag portion 111, top edge 117 of support portion 116, and a portion of top edge 107 of base portion 106 are illustrated. Also, a top view of score 124 is illustrated. Score 124 is formed on both first surface 102 and second surface 104 of marketing display insert 100 as an indentation in the sheet material, which can be formed during the die cutting of marketing display insert 100.

Figure 4:
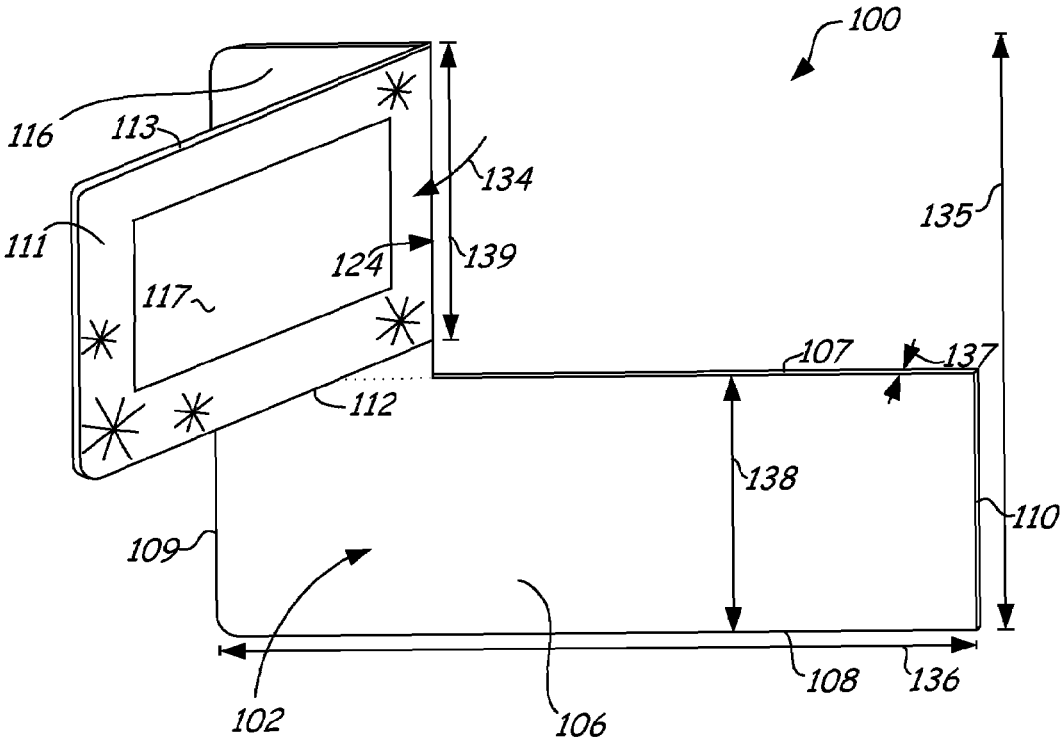
FIG. 4 is a perspective view of the marketing display insert illustrated in FIGS. 1 and 2 as inserted into a price label fixture under one embodiment.

FIG. 4 is a perspective view of marketing display insert 100 under one embodiment. As illustrated in FIG. 4, marketing display insert 100 includes a marketing display insert height 135 that extends from bottom edge 108 of base portion 106 to top edge 113 of flag portion 111, a marketing display insert width or base portion width 136 that extends from first side end 109 to second side end 110 of base portion 106, a marketing display insert thickness 137 that extends from first surface 102 to second surface 104, a base portion height 138 that extends from bottom edge 108 to top edge 107 of base portion 106 and a flag portion height 139 that extends from bottom edge 112 to top edge 113 of flag portion 111. Under one embodiment, marketing display insert width or base portion width 136 is greater than base portion height 138. In some embodiments, marketing display insert height 135 is about 2 7/16 inches, marketing display insert width or base portion width 136 is about 3 5/8 inches, marketing display insert thickness 137 is about 20 mils, base portion height 138 is about 1 1/32 inches and flag portion height 139 is about 1 1/4 inches, for example. Again, these values are exemplary dimensional values and each height, width or thickness can be any value as long marketing display insert is sized to fit relative to a price label fixture on different types of display structures.

As illustrated in FIG. 4, flag portion 111 can be bent out of plane from substantially coplanar support portion 116 and base portion 106 along score 124. Thus, flag portion 111 can be in two different orientations. In a first orientation, flag portion 111 is out of plane from support portion 116 and base portion 106 as shown in FIG. 4. In a second orientation, flag portion 111 remains substantially coplanar with support portion 116 and base portion 106 as shown in FIGS. 1, 2 and 3.

Figure 5:
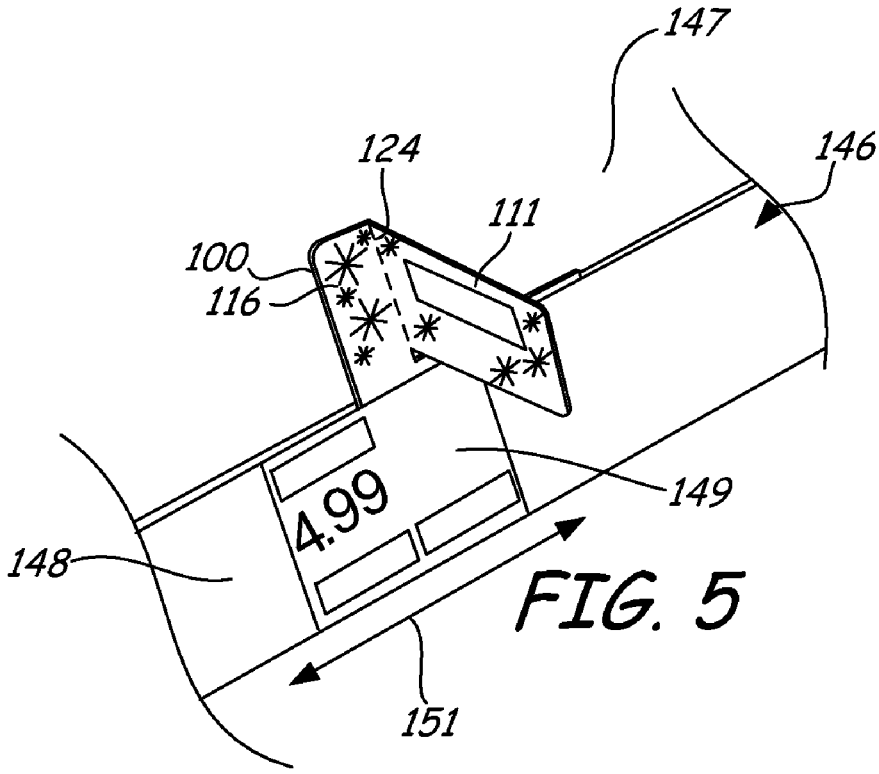
FIG. 5 is a perspective view of the marketing display insert of FIGS. 1 and 2 positioned in a price label fixture under one embodiment.
Figure 6:
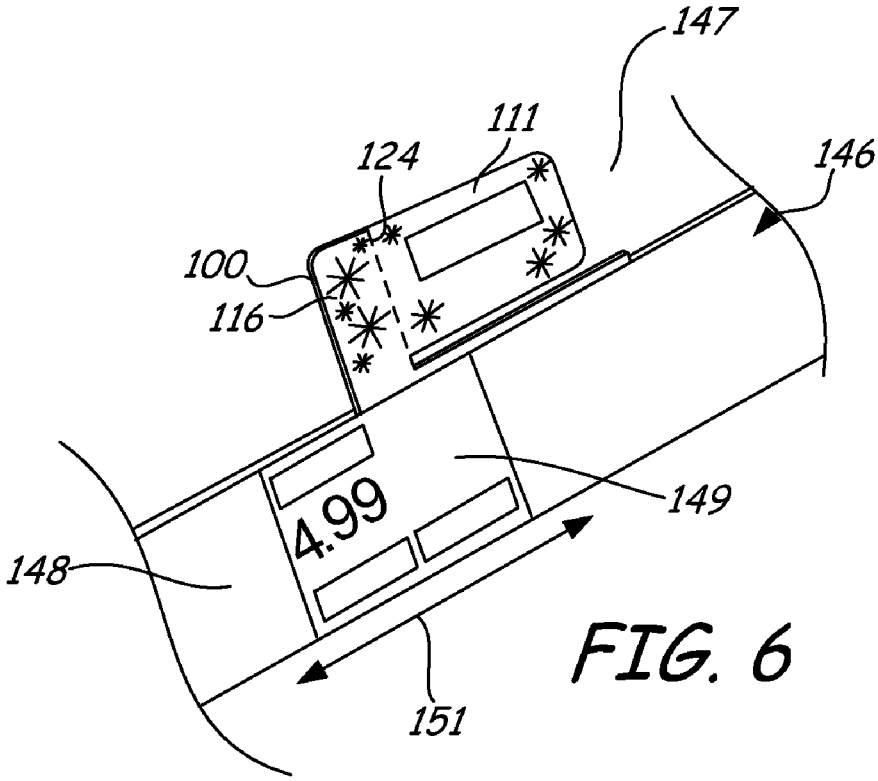
FIG. 6 is a perspective view of the marketing display insert of FIGS. 1 and 2 positioned in a price label fixture under one embodiment.
Figure 7:
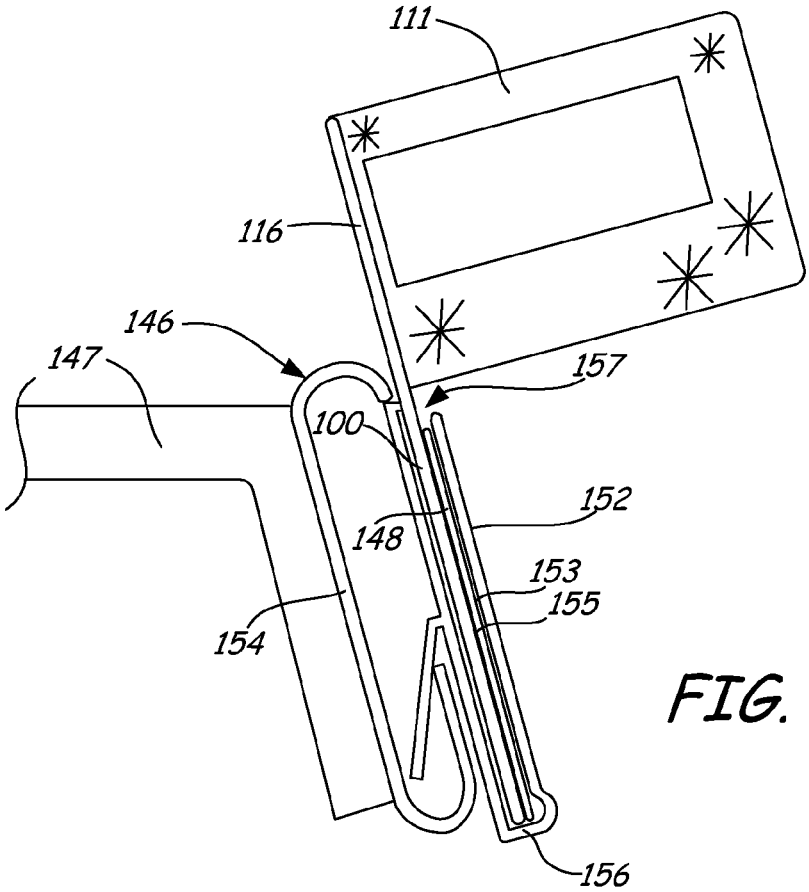
FIG. 7 is a side view of the marketing display insert positioned in the price label fixture illustrated in FIG. 5.
Figure 8:
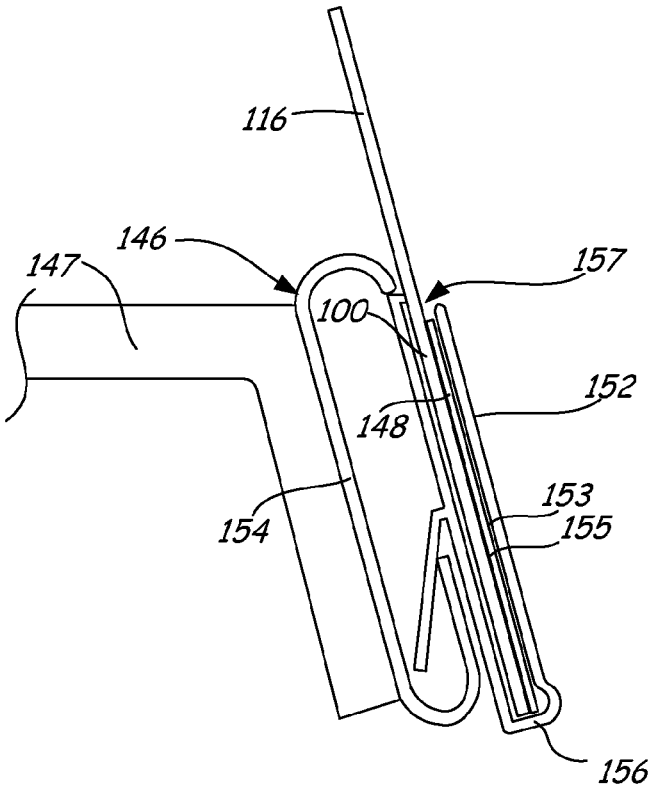
FIG. 8 is a side view of the marketing display insert positioned in the price label fixture illustrated in FIG. 6.

FIGS. 5 and 6 are perspective views of marketing display insert 100 as inserted into a price label fixture 146 on a shelf 147 of a shelf-type display structure under one embodiment. FIGS. 7 and 8 are side views of the marketing display insert 100, the price label fixture 146 and the shelf 147 of FIGS. 5 and 6, respectively. In FIGS. 5 and 7, flag portion 111 is bent out of plane from substantially coplanar support portion 116, while in FIGS. 6 and 8, flag portion 111 is substantially in plane with support portion 116.

Price label fixture 146 includes label strip 148, a support channel 154 and a price holder 156 that each extend along the entire width 151 of a shelf 147. Label strip 148 includes a front surface 153 and an opposing back surface 155. Support channel 154 is coupled to or is an integral part of a shelving unit display structure and is configured to support price holder 156. Shelf 147 and support channel 154 are typically formed of a metallic material. Price holder 156 is configured to retain label strip 148 and typically is formed of a polymer such as plastic. At least front side 152 of price holder 156 is formed of a transparent polymer such that front surface 153 of label strip 148 can be clearly viewed. As illustrated in embodiments of FIGS. 7 and 8, marketing display insert 100 is also retained in price holder 156 and is positioned adjacent back surface 155 of label strip 148. As also illustrated in FIGS. 7 and 8, marketing display insert 100 is inserted in price holder 156 behind label strip 148 from a top end 157 of the holder because price holder 156 extends along the entire width of support channel 154. In FIGS. 5-8, support portion 116 of marketing display insert 100 extends out of price holder 156 to support flag portion 111.

As illustrated under one embodiment in FIGS. 5 and 6, label strip 148 can be a continuous in-line strip of sheet material wherein price indicia 149 are printed at varying positions on label strip 148. In some embodiments, each price indicia 149 can be adhered to label strip 148. In some embodiments, each price indicia 149 is its own price label and is inserted into price label fixture 146 in front of label strip 148 and is spaced apart from other price labels. Marketing display insert 100 is inserted into price label fixture 146 generally behind label strip 148 to enhance the visual appearance of the space around price indicia 149.

Figure 9:
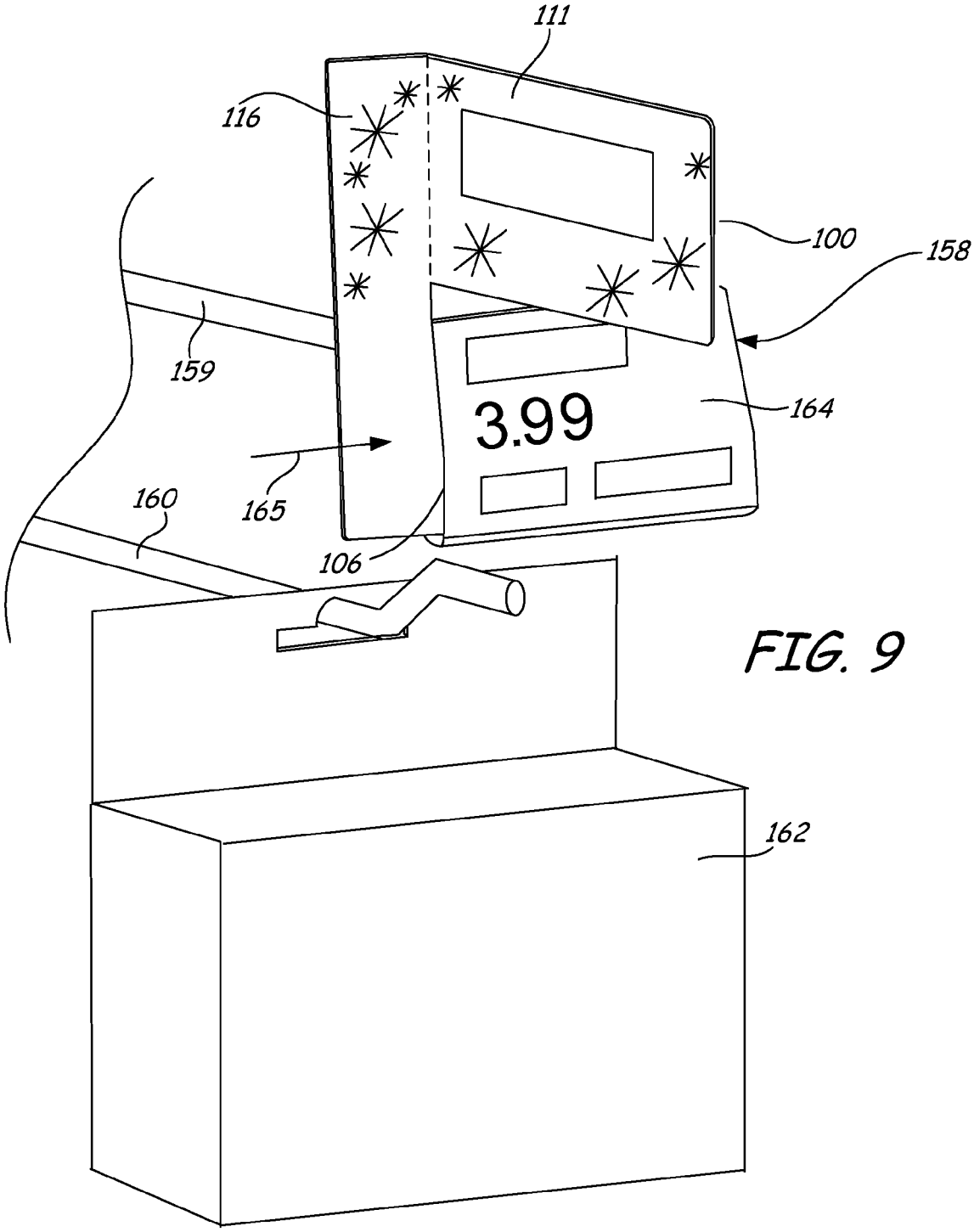
FIG. 9 is a perspective view of the marketing display insert of FIGS. 1 and 2 positioned in a price label fixture under one embodiment.
Figure 10:
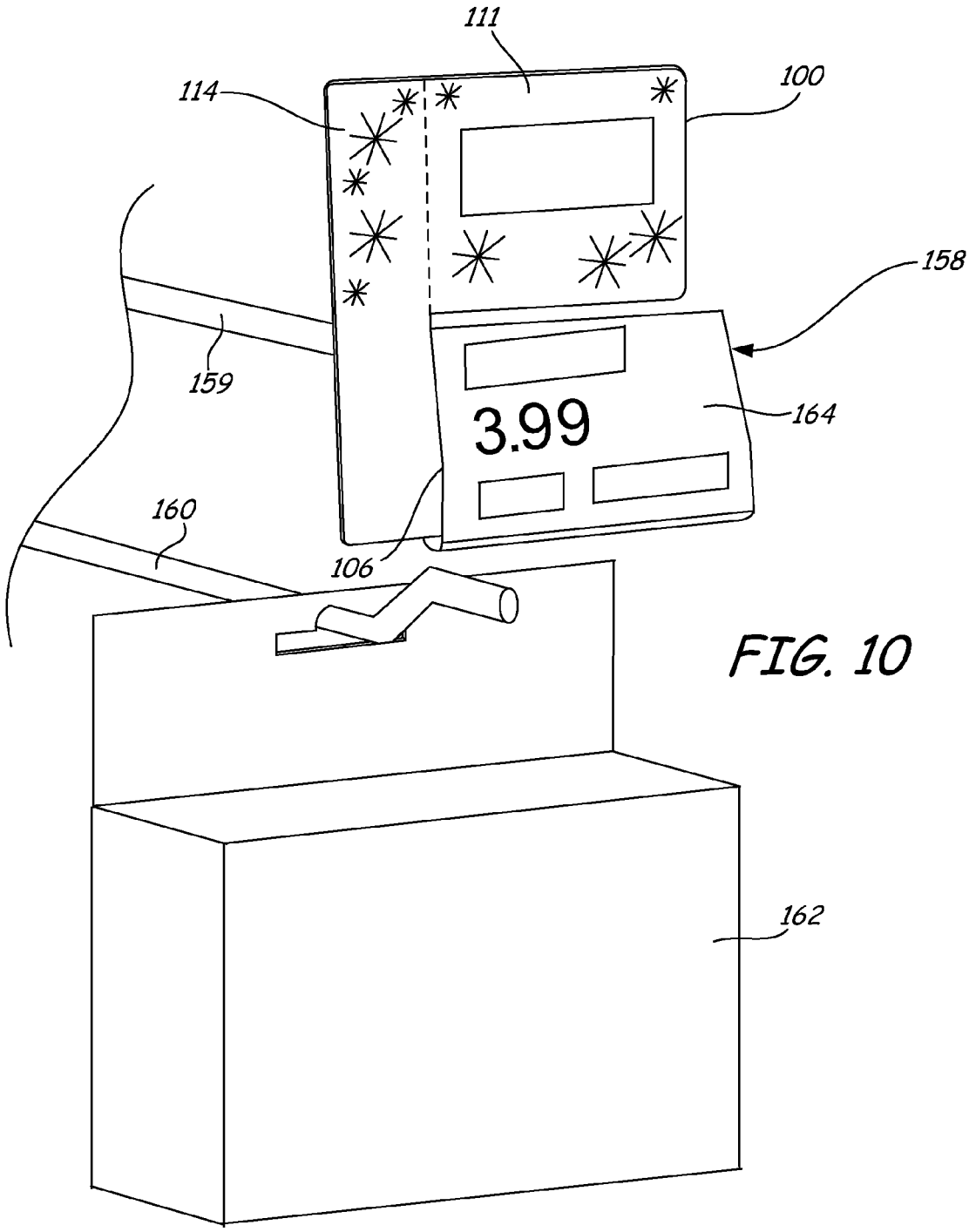
FIG. 10 is a perspective view of the marketing display insert of FIGS. 1 and 2 positioned in a price label fixture under one embodiment.
Figure 11:
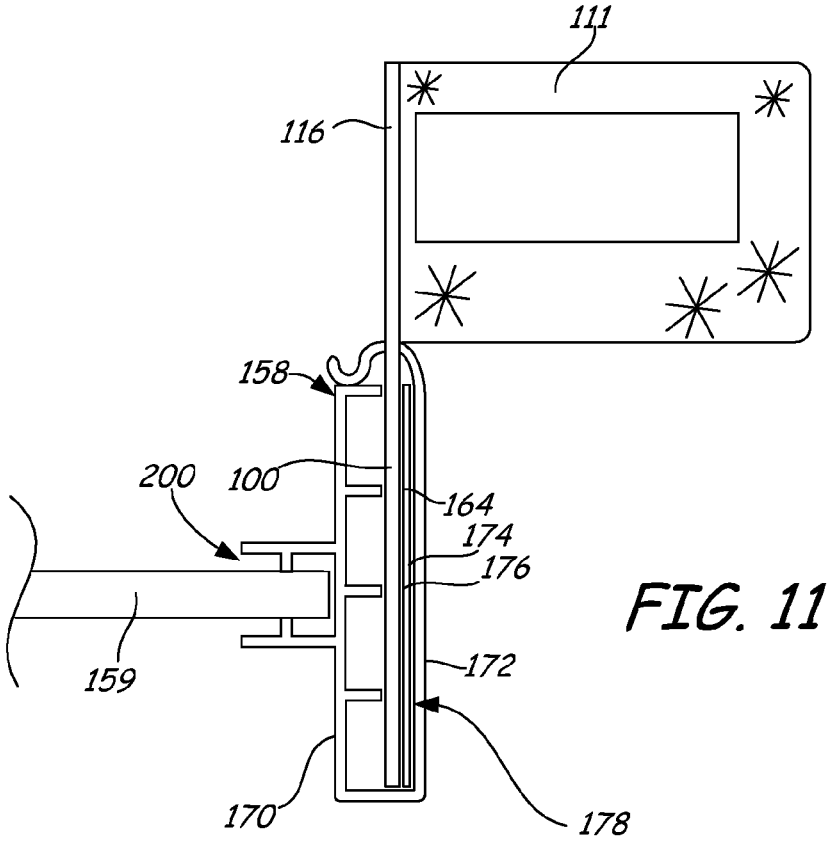
FIG. 11 a side view of the marketing display insert positioned in the price label fixture illustrated in FIG. 9.
Figure 12:
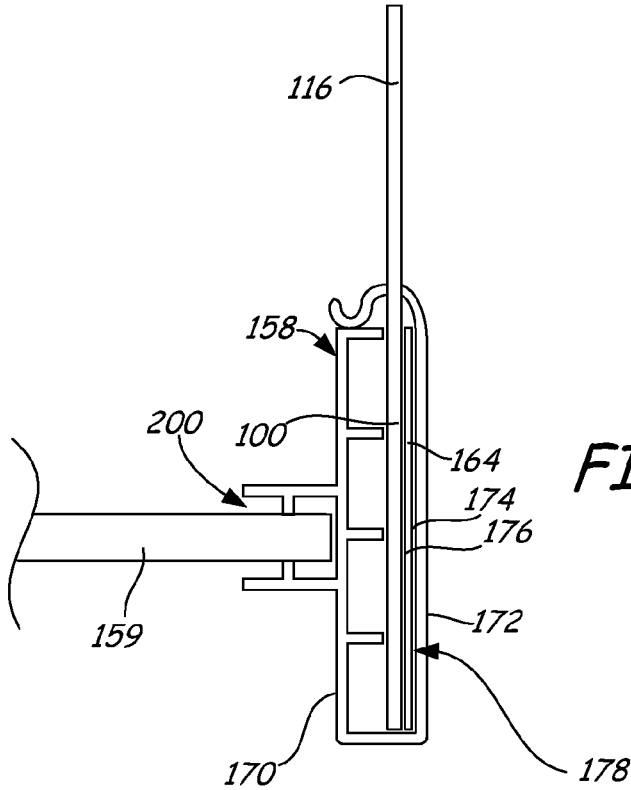
FIG. 12 a side view of the marketing display insert positioned in the price label fixture illustrated in FIG. 10.

FIGS. 9 and 10 are perspective views of marketing display insert 100 as inserted into a price label fixture 158 on a pegged hook-type display structure under one embodiment. FIGS. 11 and 12 illustrate side views of marketing display insert 100 positioned in price label fixture 158 as shown in FIGS. 9 and 10, respectively. In FIGS. 9 and 11, flag portion 111 is oriented in a first orientation in which it is bent out of plane from substantially coplanar support portion 116 and base portion 106. In FIGS. 10 and 12, flag portion 111 is oriented in a second orientation in which it is substantially in plane with substantially coplanar support portion 116 and base portion 106.

Price label fixture 158 includes price label 164 and a price holder 170. Price label 164 is a sheet of material that includes a front surface 174 with pricing information and an opposing back surface 176. Price holder 170 is coupled to and supported by first peg hook 159 and typically is formed of a polymer such as plastic. At least the front side 172 is formed of a transparent polymer such that price label 164 can be clearly viewed. Under one embodiment, price holder 170 is mounted on first peg hook 159 by inserting peg hook 159 into an opening 200 such that peg hook 159 makes frictional contact with price holder 160. Peg hook 159 is attached to a peg board (not illustrated). A second peg hook 160 is attached to the peg board and configured to support a product 162 such that product 162 hangs from second hook 160.

As illustrated in FIGS. 9-12, marketing display insert 100 is retained in price holder 170 and is positioned adjacent back surface 176 of price label 164. Marketing display insert 100 is inserted into price holder 170 behind price label 164 from side 178 in a direction indicated by arrow 165. In FIGS. 9-12, support portion 116 of marketing display insert 100 extends out of price holder 170 to support flag portion 111.

The unique shape of marketing display insert 100 allows it to be used in multiple different price label fixtures. For shelf-type display structures, the positioning of the flag above the base portion allows marketing display insert 100 to be inserted into the top of price label fixture 146 without obscuring the information on the flag portion. For peg hook-type display structures, the space between the base portion and the flag portion and the fact that the base portion is wider than it is tall allows the base portion to be inserted into price label fixture 158 from the side such that the flag portion appears above the price fixture. In addition, the score 124 allows the flag portion to be bent out of plane from the base portion in the price label fixtures for both the shelf-type display structures and the peg hook-type display structures.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A marketing display insert comprising:

a base portion having a top edge, a bottom edge, a first side end and a second side end that opposes the first side end, the base portion including a length extending from the first side end to the second side end that is greater than a height extending from the top edge to the bottom edge of the base portion, wherein the base portion is adapted for fitting within a price label fixture of a display structure;

a flag portion having a bottom edge that faces the top edge of the base portion;

a support portion having a top edge, a bottom end opposing the top edge, a first side end that is linear alignment with and continuous with the first side end of the base portion and a second side end opposing the first side end, the support portion coupling the base portion to the flag portion;

a first convexly rounded corner located at a junction of the bottom edge of the flag portion and a free side end of the flag portion;

a second convexly rounded corner located at a junction of a top edge of the flag portion and the free side end of the flag portion;

a third convexly rounded located at a junction of the top edge of the support portion that is continuous with the top edge of the flag portion and the first side end of the support portion that is continuous with the first side end of the base portion;

a fourth convexly rounded corner located at a junction of the bottom edge of the base portion and the first side end of the base portion;

wherein the top edge of the base portion and the bottom edge of the flag portion include corresponding first ends that terminate at the support portion and second ends that are free from the support portion such that the second end of the bottom edge of the flag portion is separated from the top edge of the base portion by a first distance that is at least as great as a second distance between the first end of the top edge of the base portion and the first end of the bottom edge of the flag portion; and wherein the base portion, the flag portion and the support portion comprise a sheet material.

2. The marketing display insert of claim 1, wherein the flag portion further comprises:

an attached end opposing the free side end, the attached end coupled to the second side end of the support portion along a score.

3. The marketing display insert of claim 2, wherein the sheet material comprises polystyrene.

4. The marketing display insert of claim 1, wherein the base portion and the support portion are configured to be substantially coplanar.

5. The marketing display insert of claim 4, wherein the flag portion is configured into a first orientation such that the flag portion is bent out of plane from the base portion and the support portion.

6. The marketing display insert of claim 5, wherein the flag portion is configured into a second orientation such that the flag portion is substantially coplanar with the base portion and the support portion.

7. The marketing display insert of claim 1, wherein the first distance is substantially equal to the second distance.

8. The marketing display insert of claim 7, wherein the first distance and the second distance comprise at least about 1/16 of an inch.

9. The marketing display insert of claim 8, wherein the first distance and the second distance comprise about 5/32 of an inch.

10. The marketing display insert of claim 1, further comprising a first surface and an opposing second surface, wherein the first surface and the second surface include indicia on the flag portion and support portion.

11. The marketing display insert of claim 1, wherein the base portion is adapted for fitting within a price label fixture of a shelf display structure.

12. The marketing display insert of claim 11, wherein the base portion is further adapted for fitting within a price label fixture of a peg hook display structure.

13. A marketing display insert comprising:

a bottom portion having a linear top edge that defines an edge of the display insert;

a cantilevered portion comprising a first surface and a second surface opposite the first surface, the first surface and the second surface of the cantilevered portion including indicia;

a connecting portion that couples the bottom portion to the cantilevered portion and that has a first side edge that terminates at the top edge of the bottom portion wherein the first side edge is at an angle to the top edge of the bottom portion at the point where the first side edge terminates at the top edge;

a first convexly rounded corner located at a junction of a bottom edge of the cantilevered portion and a free side end of the cantilevered portion;

a second convexly rounded corner located at a junction of a top edge of the cantilevered portion and the free side end of the cantilevered portion;

a third convexly rounded corner located at a junction of a top edge of the connecting portion that is continuous with the top edge of the cantilevered portion and a second side edge of the connecting portion that is continuous with a first side end of the bottom portion;

a fourth convexly rounded corner located at a junction of a bottom edge of the bottom portion and the first side end of the bottom portion; and wherein the bottom portion and the connecting portion are substantially coplanar and the cantilevered portion is bent out of plane from the bottom portion along a score between the cantilevered portion and the connecting portion that is along a line that separates the cantilevered portion from the connecting portion and that intersects with a line that the top edge of the bottom portion extends along.

14. The marketing display insert of claim 13, wherein the indicia on the first surface and the second surface of the cantilevered portion comprise textual indicia including alpha-numeric characters.

15. The marketing display insert of claim 13, further comprising decorative indicia included on the first surface and the second surface of the connecting portion and the cantilevered portion.

16. A product display structure comprising:

a price label having a front surface and an opposing back surface;

a price holder configured to retain the price label;

a marketing display insert also retained in the price holder and positioned adjacent to the back surface of the price label, the marketing display insert comprising:

a base portion adjacent to the back surface of the price label and having a top edge;

a flag portion;

a support portion extending out of the price holder that couples the base portion to the flag portion and that is coplanar with the base portion; and a score between the flag portion and the support portion along a line intersecting a line along which the top edge of the base portion extends; and wherein the base portion and the support portion are substantially coplanar and wherein the flag portion is configured to be bent out of plane along the score from the base portion.

17. The product display structure of claim 16, wherein the product display structure is a peg hook display structure and wherein the price holder is coupled to and supported by the peg hook display structure.

18. The product display structure of claim 16, wherein the product display structure is a shelf display structure and wherein the price holder is supported by a support channel coupled to the shelf display structure.

19. The product display structure of claim 16, wherein the marketing display insert comprises a first surface and an opposing second surface, wherein the first surface and the second surface include indicia.

20. The product display structure of claim 16, wherein the flag portion is configured to be oriented substantially coplanar with the base portion and the support portion.

21. A method of applying a marketing display insert to a product display structure, the method comprising:

attaching a price label fixture to the product display structure for holding a price label;

inserting the marketing display insert in the price label fixture behind the price label, the marketing display insert comprising:

a base portion having a top edge;

a flag portion;

a support portion that couples the base portion to the flag portion and is coplanar with the base portion;

a score between the flag portion and the support portion along a line intersecting a line along which the top edge of the base portion extends;

bending the flag portion along the score such that the flag portion is out of plane from the base portion and the support portion; and wherein insert the marketing display insert in the price label fixture comprises inserting the base portion in the price label fixture such that the support portion extends out of the price label fixture and such that the flag portion is outside of the price label fixture.

22. The method of claim 21, wherein attaching a price label fixture to the product display structure for holding a price label comprises attaching a price label fixture to a peg hook display structure.

23. The method of claim 21, wherein attaching a price label fixture to the product display structure for holding a price label comprises attaching a price label fixture to a shelf display structure.

* * * * *